US006857504B1

(12) United States Patent
Branter

(10) Patent No.: US 6,857,504 B1
(45) Date of Patent: Feb. 22, 2005

(54) ROOF RETAINING APPARATUS

(76) Inventor: Jerome Branter, 33725 Palm Dr., Burlington, WI (US) 53105

( * ) Notice: Subject to any disclaimer, the term of this patent is extended or adjusted under 35 U.S.C. 154(b) by 0 days.

(21) Appl. No.: 10/026,092

(22) Filed: Dec. 21, 2001

(51) Int. Cl.[7] ..... E04G 3/12

(52) U.S. Cl. ..... 182/113; 182/45; 52/26; 248/237; 256/59

(58) Field of Search ..... 52/24–26, 660; 248/237, 248/238; 256/1, 59, 65; 182/45, 113, 82, 138; 473/478, 485, 488, 474

(56) References Cited

U.S. PATENT DOCUMENTS 1,255,692 A * 2/1918 Bearden ..... 248/237
1,646,923 A * 10/1927 Martens ..... 248/237
3,527,319 A * 9/1970 Pedley ..... 182/139
3,880,405 A * 4/1975 Brueske ..... 256/59
3,901,481 A * 8/1975 Probst ..... 256/59
4,805,735 A * 2/1989 Anderson ..... 182/138
5,515,941 A * 5/1996 Palmer et al. ..... 182/45
5,779,227 A * 7/1998 Elkins et al. ..... 256/31
6,003,629 A * 12/1999 Cloutier et al. ..... 182/45
6,053,281 A * 4/2000 Murray ..... 182/113
6,220,390 B1 * 4/2001 Pike ..... 182/45

FOREIGN PATENT DOCUMENTS

GB 2113285 * 8/1983
GB 2157755 * 10/1985

* cited by examiner

*Primary Examiner*—Winnie Yip
(74) *Attorney, Agent, or Firm*—Kajane McManus

(57) ABSTRACT

The apparatus comprises a framework having two angled arms, one flat portion of each arm adapted to be fixed to a rooftop. An upright extends upwardly from each arm and top and bottom cross members extend between and are fixed to the arms. Multiple arms, uprights and cross members are joinable together to accommodate a rooftop of any lateral extent. A net extends across the area defined by and between the uprights and cross members. Also, the arms include brace structure adapted for engaging scaffolding thereacross.

7 Claims, 2 Drawing Sheets

ROOF RETAINING APPARATUS

BACKGROUND OF THE INVENTION

1. Field of the Invention

The present invention relates to a roof retaining apparatus. More particularly, the retaining apparatus incorporates at least a framework with netting stretched thereacross, the framework being fixable to a slanted roof structure to keep debris and workers from falling therepast.

2. Prior Art

Heretofore various apparatus have been proposed for maintaining things, and persons, on a slanted rooftop.

For example, U.S. Pat. No. 5,749,438 discloses a protective device mounted at the base of a roof and comprising a framework upon which a net is engaged, the framework being held in position by bracing wires engaged to the roof.

Still further, U.S. Pat. No. 6,220,390 discloses a rooftop scaffolding system which engages a slanted roof and has a moveable platform thereon upon which a worker stands.

Yet further, U.S. Pat. No. 4,805,735 discloses a guard system for a scaffolding arrangement which includes a net wall spanning gap between upper and lower platforms of the device.

However, to date no one has yet proposed the roof retaining apparatus which both creates a scaffold and has a net thereabove, with as many apparatus as necessary being engageable one to the other so as to accommodate any required expanse of roof.

SUMMARY OF THE INVENTION

According to the invention there is provided a framework comprising at least two angulated arms, an upright post engaged to each arm, upper and lower cross members engaged to and between the arms, the arms having structure thereon for mounting scaffolding thereover and a net stretched between and fixed to the upright posts and cross members.

DESCRIPTION OF THE PREFERRED EMBODIMENTS

Figure 1:
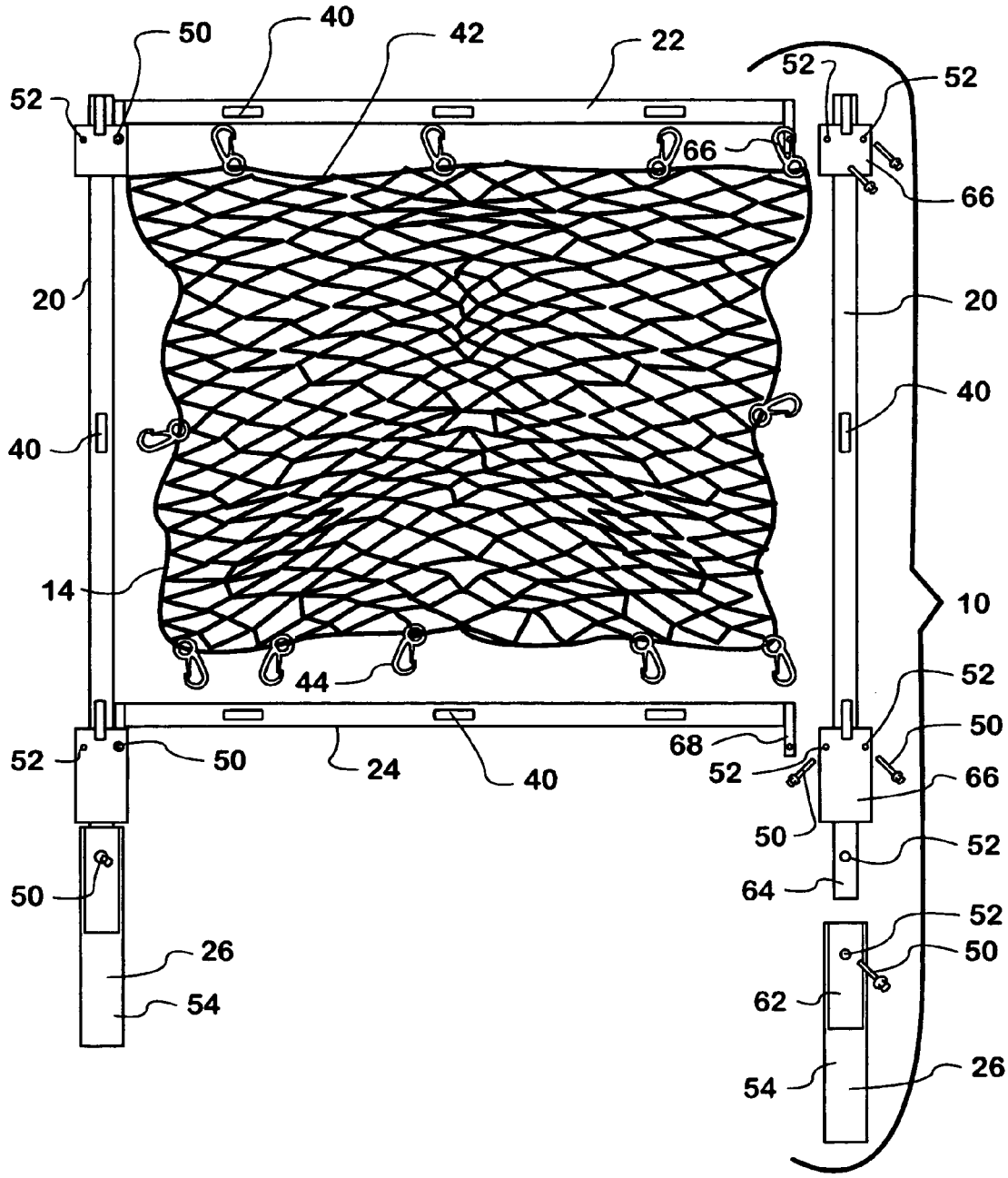
FIG. 1 is a perspective view of a roof retaining apparatus made in accordance with the teachings of the present invention.

Referring now to the drawings in greater detail there is illustrated therein a roof retaining apparatus made in accordance with the teachings of the present invention and generally identified by the reference numeral 10.

Figure 2:
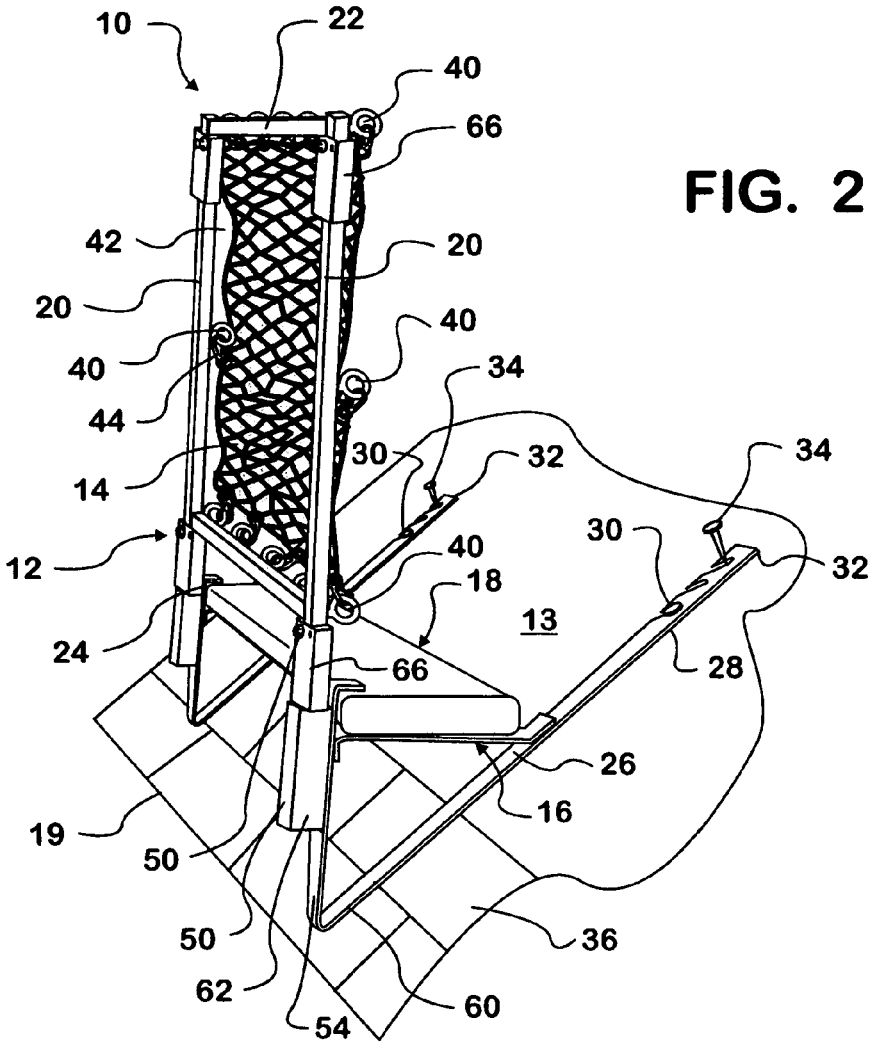
FIG. 2 is a perspective view of the apparatus of FIG. 1 shown mounted to a slanted.

As shown in the apparatus 10 comprises a framework 12 which is adapted to engaged a slanted roof 13 (FIG. 2), a net 14 and a structure 16 (FIG. 2) used in creating a scaffold 18 upon which a roofer may stand near a bottom edge 19 of the roof 13.

The framework 12 includes two upstanding posts or uprights 20 to which at least one top cross member 22 and one bottom cross member 24 is engageable.

The upstanding posts 20 themselves engage angulated roof engaging arms 26 which arms 26 each further support the structure 16, in the form of a brace element 16, which cooperate to form and support the scaffold 18, positioned proximate to the bottom cross member 22.

The arms 26 each include an elongated planar portion 28 which flushly overlies the roof 13 and engages to the roof 13 through engagement slots 30 in the free end 32 of the planar portion 28, the slots 30 engaging over securements 34, such as nails 34, driven into the roof 13. It will be understood that the slots 30 are provided so that, once roofing material 36 has been applied thereover, the arms 26 need merely be slid sideways, at a slight angle, to remove them without disturbing the applied roofing material 36 to any significant degree.

Next it will be appreciated that the uprights 20 and cross members 22, 24 are all provided with spaced apart net 14 engaging members 40, such as eyes 40 illustrated, with end edges 42 of the net 14 having corresponding positioned therealong eye engaging members 44, such as hooks 44 illustrated, which cooperate with the eyes 40 for allowing stretching of the net 14 across the space defined within the engaged uprights 20 and cross members 22, 24.

It also will be understood that at least two uprights 20 are required to construct the framework 12 of the apparatus 10 of the present invention.

Figure 3:
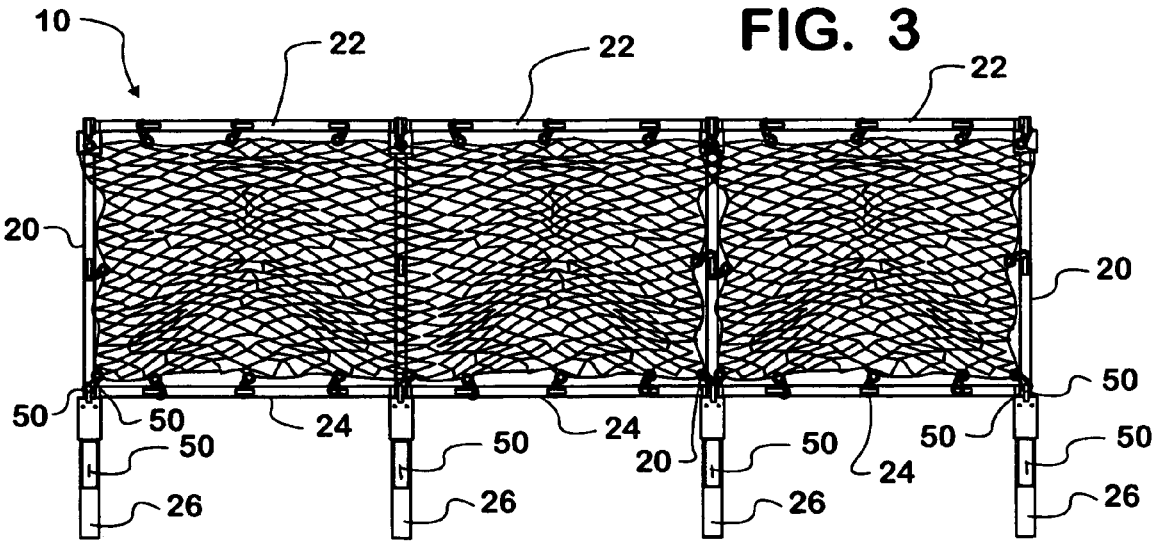
FIG. 3 is a perspective view showing a plurality of apparatuses engaged to accommodate a longer section of roof.

However, as best illustrated in FIGS. 1 and 3, this should not be construed at limiting.

In this respect, as shown, the uprights 20 are each adapted to engage two top and two bottom cross members 22 and 24, respectively, one to either side thereof.

Thus, when the expanse of roof 13 increases beyond the stretch of one framework 12, multiple uprights 20 and cross members 22, 24 are engageable to each other to provide an extended framework 12 which accommodates the required expanse, with one elongate, or multiple, net(s) 14 extending across the expanse of the extended framework 12.

For added benefit and strengthening of the framework 12, if desired, points of joining between the uprights 20, cross members 22, 24, and arms 26 can be secured through insertion of pins 50 into corresponding aligned engagement ports 52 formed within the various structures 20,22, 24 and 26, to be joined, as best illustrated in FIG. 1.

With respect to the manner of joining the various structures of the framework 12 together, it will be seen that each arm 26 includes an upstanding flange 54 at an end 60 opposite the free end 32 thereof. Along the upstanding flange 54 there is provided a sleeve 62 into which a bottom end flange 64 of an upright 20 is received.

Mounted along a lower area of each upright 20 is a sleeve 66 which is sized and configured to receive therein two end flanges 68 of adjacently positioned bottom cross members 24, in drop in fashion.

Another identical sleeve 66 is mounted along an upper area of each upright 20 as well, for receiving therein, also in drop in fashion an end flange 66 of each of two adjacent top cross members 22.

Such simple means of forming the joinings of the various framework 12 structures makes the apparatus 10 very easy to build.

Further, the simple manner of engaging and disengaging of the apparatus 10 from its roof 13 mounting also makes the apparatus 10 very easy to manipulate, a definite advantage when one is dealing with a slanted roof 13.

Still further, positioning of the scaffold forming brace elements 16 substantially at a position adjacent the bottom cross member 24 maintains debris, as well as a roofer, from falling past the net 14, forming, as it were, a "floor" for the apparatus 10, as well as providing a more horizontal surface than that offered by the roof 13, upon which a roofer may more securely stand.

As described above, the apparatus 10 provides a number of advantages, some of which have been described above and others of which are inherent in the invention. Also, modifications may be proposed to the apparatus 10 without departing from the teachings herein. Accordingly, the scope of the invention is only to be limited as necessitated by the accompanying claims.

I claim:

1. A roof retaining apparatus comprising a framework including at least two angulated arms each including a flat portion having slots therein for individually engaging over fixation devices fixed to the roof, the arms each having an upstanding flange angularly extending from the flat portion, the upstanding flange having an upstanding sleeve mounted thereon, an upright having a bottom end flange inserted and secured to the upstanding sleeve of each arm, upper and lower cross members engaged to and between the uprights, the uprights having top and bottom lateral sleeve pairs secured thereon, the top and bottom cross members each having vertical end flanges being vertically received within the lateral sleeves respectively the arms also having a support thereon for mounting a scaffolding thereover and a net stretched between and fixed to the uprights and cross members, wherein said lateral sleeves and said cross member end flanges have aligned bores therein, and a pin is engaged through the aligned bores to secure the uprights and cross members together.

2. The apparatus of claim 1 wherein the slots are formed toward a free end of each arm.

3. The apparatus of claim 2 wherein the slots are angulated relative to the free end of the arm.

4. The apparatus of claim 3 wherein each upright engages up to two top cross members, one to either side thereof.

5. The apparatus of claim 4 wherein each upright engages up to two bottom cross members, one to either side thereof.

6. The apparatus of claim 1 wherein said upstanding sleeve and said upright bottom end flanges have aligned bores therein.

7. The apparatus of claim 6 wherein a pin is engaged through the aligned bores to secure the uprights and arms together.

* * * * *

UNITED STATES PATENT AND TRADEMARK OFFICE

CERTIFICATE OF CORRECTION

PATENT NO. : 6,857,504 B1
DATED : February 22, 2005
INVENTOR(S) : Jerome Brantner It is certified that error appears in the above-identified patent and that said Letters Patent is hereby corrected as shown below:

Title page,
Item [75], Inventor, should be -- Jerome Brantner --

Signed and Sealed this

Seventeenth Day of May, 2005

JON W. DUDAS
*Director of the United States Patent and Trademark Office*